US012693079B2

(12) United States Patent
Dubuisson et al.

(10) Patent No.: US 12,693,079 B2
(45) Date of Patent: Jul. 28, 2026

(54) HEAT EXCHANGER UNIT AND METHOD FOR FLUID TO PASSIVELY BYPASSING A HEAT EXCHANGER

(71) Applicant: Bosal Flanders NV, Lummen (BE)

(72) Inventors: Michel Dubuisson, Sittard (NL); Martijn Luyck, Hasselt (BE); Jean-Paul Hubert Janssens, Leopoldsburg (BE)

(73) Assignee: Bosal Flanders NV, Lummen (BE)

( * ) Notice: Subject to any disclaimer, the term of this patent is extended or adjusted under 35 U.S.C. 154(b) by 515 days.

(21) Appl. No.: 18/158,915

(22) Filed: Jan. 24, 2023

(65) Prior Publication Data

US 2023/0235972 A1 Jul. 27, 2023

(51) Int. Cl.
*F28D 21/00* (2006.01)
*F28F 27/02* (2006.01)

(52) U.S. Cl.
CPC ..... *F28D 21/0003* (2013.01); *F28F 27/02* (2013.01); *F28F 2250/06* (2013.01)

(58) Field of Classification Search
CPC .... F28D 21/0003; F28F 27/02; F28F 2250/06
See application file for complete search history.

(56) References Cited

U.S. PATENT DOCUMENTS 6,141,961 A * 11/2000 Rinckel ..... F01N 3/043 60/287
7,243,707 B2 * 7/2007 Brost ..... F28D 9/0037 165/103
8,714,238 B2 5/2014 Won
9,140,146 B2 9/2015 Hartmann et al.
9,664,087 B2 * 5/2017 Sloss ..... F02D 9/10
10,222,129 B2 * 3/2019 Finstad ..... F28F 9/0273
10,378,831 B2 * 8/2019 Ling ..... F28F 3/025
10,767,605 B2 * 9/2020 Yamada ..... F28F 9/013
11,073,341 B2 * 7/2021 Cowburn ..... F28D 19/044
2009/0056909 A1 3/2009 Braun
2019/0249627 A1 * 8/2019 Takagi ..... F28D 21/0003

FOREIGN PATENT DOCUMENTS

DE 19962863 A1 6/2001
GB 2477316 A 8/2011

OTHER PUBLICATIONS

Search Report for European Patent Application No. 22153551.1, 7 pages (Jul. 1, 2022).

* cited by examiner

*Primary Examiner* — Jon T. Schermerhorn, Jr.
(74) *Attorney, Agent, or Firm* — Merchant & Gould P.C.

(57) ABSTRACT

The invention relates to a heat exchanger unit for an exhaust gas system. The heat exchanger unit comprises an inlet for a fluid flow to enter the heat exchanger unit and an outlet for a fluid flow to exit the heat exchanger unit. The heat exchanger unit comprises a heat exchanger having a heat exchanger conduit passing through the heat exchanger and at least one bypass conduit bypassing the heat exchanger, wherein the at least one bypass conduit comprises a bypass core having a plurality of channels arranged longitudinally along the bypass conduit.

22 Claims, 4 Drawing Sheets

HEAT EXCHANGER UNIT AND METHOD FOR FLUID TO PASSIVELY BYPASSING A HEAT EXCHANGER

This application claims benefit of EP Application No. 22153551.1, filed on 27 Jan. 2022 in the European Patent Office and which application is incorporated herein by reference in its entirety. To the extent appropriate, a claim of priority is made to the above disclosed application.

The invention relates to a heat exchanger unit for an exhaust gas system and a method for a fluid flow passively bypassing a heat exchanger.

In heat exchangers, a portion of a gas flow is often made to bypass the heat exchanger for various reasons. The amount of flow through the bypass may be actively controlled, for example via valve or flow controller. A passive bypass may be preferred as no moving parts are available in a bypass conduit. However, passive bypasses are often not well suited as a passive bypass is typically designed to bypass a preferred fraction of the flow at a specific temperature and flow.

Therefore, there is a need for a heat exchanger unit with a passive bypass that is available for large temperature and/or flow ranges.

According to the invention, there is provided a heat exchanger unit for an exhaust gas system. The heat exchanger unit comprises an inlet for a fluid flow to enter the heat exchanger unit and an outlet for a fluid flow to exit the heat exchanger unit. The heat exchanger unit further comprises a heat exchanger having a heat exchanger conduit passing through the heat exchanger and at least one bypass conduit bypassing the heat exchanger. Therein the at least one bypass conduit comprises a bypass core having a plurality of channels arranged longitudinally along the bypass conduit.

Preferably, the plurality of channels is arranged parallel to each other in the bypass core. 'Parallel' may be exactly parallel or substantially parallel, for example deviating by about 20 percent from the exact parallel orientation.

By the provision of a plurality of channels in the bypass conduit, a pressure drop in the bypass conduit may be adapted to a pressure drop in the heat exchanger. The design of the bypass core allows for simple adaption of the physical characteristics of the bypass to those of a heat exchanger to be bypassed. Alternatively, or in addition, it allows to adapt the bypass to an amount of flow to bypass the heat exchanger and thus to a desired mixture of an outlet flow, for example having a specific temperature. By variation of, for example, the number of channels, the size of the channels or for example the diameter of a bypass core, a heat exchanger unit may be designed and adapted to a specific fluid flow and operation temperature range.

It has been found that a bypass conduit may be constructed as passive conduit, thus not comprising any active or movable parts for controlling the fluid flow thought the bypass conduit, such as valves or flow controllers, and nevertheless having constant or nearly constant characteristics in a wide flow and temperature range. A passive bypass having the additional advantage of being robust and cost efficient and low in maintenance.

In heat exchanger applications, a part of a flow shall bypass a heat exchanger. This may be done, for example, to reduce an overall pressure drop, to reduce the amount of flow treated in the heat exchanger, or to use a smaller heat exchanger due to cost or space constraints.

Thus, a heat exchanger may be adapted to operate well with different fluid flows passing through the heat exchanger or may be adapted to operate in a specific range of flow only. However, in a heat exchanger, a flow resistance is generally increasing proportionally to the flow velocity squared, but the flow resistance is generally increasing in the bypass proportionally to the velocity. Thus, if the flow is higher than the specific design value for the bypass, then the flow resistance in the bypass will not rise as fast as the flow resistance in the heat exchanger. Thus, more flow will automatically tend to pass through the bypass conduit when the flow is higher than the specific design value of the bypass and heat exchanger assembly. This will enhance the flow through the bypass conduit and at higher velocities. This is undesirable if a flow rate between flow through the heat exchanger and through the bypass shall have a defined value or shall remain constant. Such a defined rate may in particular be desired, if, for example, a temperature of an outlet flow of the heat exchanger unit shall be set to or certain value or at least be within a certain range. This may be the case, if the outlet flow after having left the heat exchanger unit is to be used as inlet flow into another device requiring a specific, preferably constant temperature, such as, for example, a fuel cell. Fuel cells have optimized working ranges, which are much dependent on the temperature of an inlet fluid.

It may be seen that the specific construction of the bypass conduit may also be designed to reduce an overall pressure drop in the heat exchanger.

In preferred embodiments of the heat exchanger unit according to the invention, the bypass core comprises between 100 channels and 800 channels, preferably 200 channels to 600 channels, for example between 250 channels and 450 channels. These ranges of a number of channels have been found to be well suitable to design heat exchanger units to be operable at wide flow and temperature ranges with substantially constant bypass characteristics.

Preferably, the heat exchanger unit comprises an array of bypass conduits, wherein each of the bypass conduits of the array of bypass conduits comprises a bypass core having a plurality of channels. The separation of the bypass flow into several bypass flows through several bypass conduits is particularly favourable for a downstream mixing of the bypass flows with the first flow having passed the heat exchanger. More and faster uniform temperature of the outlet fluid flow may be achieved.

The bypass conduits in the array of bypass conduits may be arranged according to a user's need. Preferably, at least some of the bypass conduits are arranged along a height of the heat exchanger. By this, the bypass fluid flow may be distributed over the height of the heat exchanger and thus support mixing of the first flow and the second flows. In some embodiments, all bypass conduits are arranged along the height of the heat exchanger.

An array of bypass conduits may comprise, for example, between 2 and 14 bypass conduits, preferably between 3 and 10 bypass conduits, for example 3, 4 or 6 bypass conduits. The bypass conduits of the array of conduits are preferably arranged distanced and next to each other, for example parallel to each other and above each other. Preferably, the bypass conduits are arranged equidistantly to each other. Preferably, the bypass conduits are arranged regularly in the heat exchanger unit.

The plurality of channels in a bypass core may be realized by various means. The channels may be realized, for example, by a plurality of tubes, a plurality of through-bores in a block of material or, by corrugated sheet material folded or laid onto itself.

Preferably, the bypass core is formed by corrugated sheet material, more preferably corrugated steel, most preferably corrugated stainless steel.

Preferably, the plurality of channels is formed by rolled-up corrugated sheet material.

Preferably, the plurality of channels is formed by corrugated plates arranged next to each other in the bypass core. Plates may be welded to each other to form a stable bypass core.

Preferably, the bypass core has the shape of a cylinder or the shape of a rectangular box.

The bypass core may be made of any material suitable for heat exchanger applications. Preferably, the bypass core comprises or is made of steel, preferably stainless steel.

The bypass core may, for example, be made of a sheet or several sheets or plates. A length of a sheet or a number of plated used in a bypass core may be varied according to the size and amount of channels desired in the bypass core. A bypass core may comprise, for example, between 10 and 100 plates, more preferably, between 20 and 70 plates, most preferably, between 30 and 50 plates.

The bypass core may comprise a housing having a circular, oval or rectangular cross-section, wherein the housing has an open inlet end and open outlet end. The material forming the channels is provided in the housing, wherein the channels are arranged in the direction of the open inlet end to the open outlet end. Preferably, the bypass core housing is welded into a heat exchanger unit housing, preferably in a gas tight manner. By this, it may be guaranteed that any bypass flow flows through the bypass core in the bypass conduit.

A heat exchanger unit may comprise more than one heat exchanger core. A heat exchanger core may, for example, be a stack of heat exchanging plates as known in the art. A heat exchanger unit may, for example, comprise two, three or four heat exchanger cores. Preferably, at least a bypass conduit is arranged in between neighbouring heat exchanger cores.

By the provision of several heat exchanger cores and bypass conduits, the operation and performance of the heat exchanger unit may be enhanced.

In the heat exchanger unit according to the invention, a variation of a bypass flow rate is preferably kept below 20 percent of a total flow, more preferably below 10 percent or even below 5 percent of a total flow, while a total flow varies by more than 200 percent, preferably more than 300 percent or even by up to 400 percent. For example, the bypass flow rate variations may be kept at these low values with a total flow rate of between 0.008 kg/s and 0.8 kg/s, in particular with a low total flow rate between 0.008 kg/s and 0.04 kg/s.

To achieve different bypass flow rate variations, the total number of channels in a bypass core, or the total number of channels of all bypass cores, respectively, may be varied and adapted. The number of channels of the plurality of channels may be varied, for example, between 200 channels and 600 channels in each of the bypass cores having a cross section of 40 $cm^2$ and a length of 10 cm for each bypass core.

Low bypass flow variations are in particular needed if a temperature of an outlet flow has to have a predefined temperature or has to be within a certain temperature range. For example, an outlet gas temperature of 400 degree Celsius is desired, for example as inlet gas for a fuel cell. If a hot gas, for example provided by an exhaust system, bypassing the heat exchanger has a temperature of about 900 degree Celsius and the hot gas having passed the heat exchanger has cooled down to about 200 degree Celsius, the ratio of the two flows defines the temperature of the outlet flow, thus of the mixture of the two flows. Thus, if the temperature of the outlet flow shall be kept at a defined temperature, a bypass flow rate has to remain stable.

According to the invention, there is also provided a method for a fluid flow to passively bypass a heat exchanger. The method comprises separating an inlet fluid flow into a first flow portion and a second flow portion, letting the first flow portion to pass through a heat exchanger and letting the second flow portion to bypass the heat exchanger via a bypass conduit, and combining the first flow portion and the second flow portion to an outlet fluid flow, after the first flow portion has passed the heat exchanger and after the second flow portion has bypassed the heat exchanger. In the method, the second flow portion passes a plurality of channels arranged in the bypass conduit, such that a pressure drop of the second flow portion in the bypass conduit is adapted to a pressure drop of the first flow portion in the heat exchanger.

The method may comprise, dividing the second flow portion into several, individual, second sub-flows, letting 1 the several second sub-flows bypass the heat exchanger and combining the second sub-flows with the first flow portion after the first flow portion has passed the heat exchanger.

Preferably, each of the second sub-flows passes a plurality of channels when bypassing the heat exchanger, preferably passes a plurality of channels, which are arranged in parallel in the bypass conduit.

Advantages and further features of the method have been described relating to the heat exchanger unit and will not be repeated.

An inlet fluid flow, in particular an inlet gas flow, may, for example, have a temperature between 400 degree Celsius and 1000 degree Celsius. Preferably, an inlet gas flow has a temperature above 400 degree Celsius, more preferably, above 600 degree Celsius.

Preferably, in the method according to the invention, a temperature of the outlet fluid flow is kept at a predefined temperature plus or minus 10 percent, with a temperature of the inlet fluid flow above 400 degree Celsius and a second flow portion between 40 percent and 85 percent of the inlet fluid flow. This is preferably achieved in flow rate ranges between 0.008 kilogram per second and 0.8 kilogram per second.

A second flow portion bypassing the heat exchanger may, for example, be between 30 percent and 95 percent of the first flow portion, preferably, between 50 percent and 90 percent or between 60 percent and 85 percent, for example 65 percent of the first flow portion. However, in the method and with the heat exchanger unit according to the invention, a second flow portion bypassing the heat exchanger is preferably kept constant with a variation of under 10 percent, preferably under 5 percent variation over wide operation range of temperatures and flow rates. In particular, such constant operation condition of the bypass conduit is achieved at fluid temperatures between 400 degree Celsius and 1000 degree Celsius, more preferably at fluid temperatures between 500 degree Celsius and 800 degree Celsius.

A temperature of a fluid flow, in particular a gas temperature at an inlet of the heat exchanger, is preferably between 400 degree Celsius and 1000 degree Celsius, more preferably between 500 degree Celsius and 800 degree Celsius.

Typical flow rates are between 0.008 kg/s and 0.8 kg/s, more preferably, between 0.03 kg/s and 0.6 kg/s, for example between 0.04 kg/s and 0.5 kg/s.

The heat exchanger according to the invention is particularly used in exhaust gas systems and the method according to the invention for a fluid flow being an exhaust gas. The exhaust gas may, for example, be exhaust gas of a diesel engine, a power plant or a fuel cell system. The fluid flow passing through and bypassing the heat exchanger may also be, for example, methane, hydrogen or other gas species. The invention is further described with regard to embodiments, which are illustrated by means of the following drawings, wherein.

Figure 5:
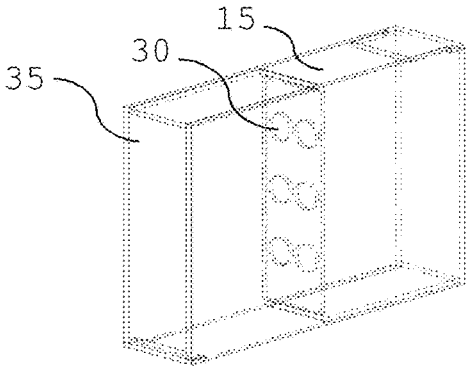
Figure 6:
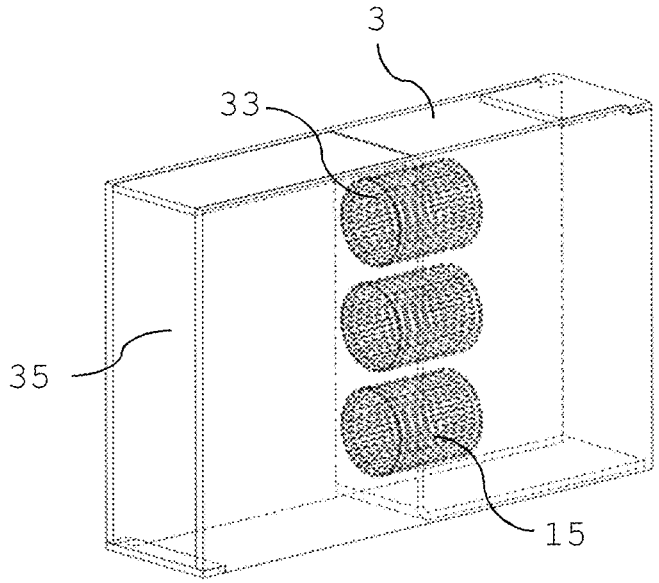
Figure 8:
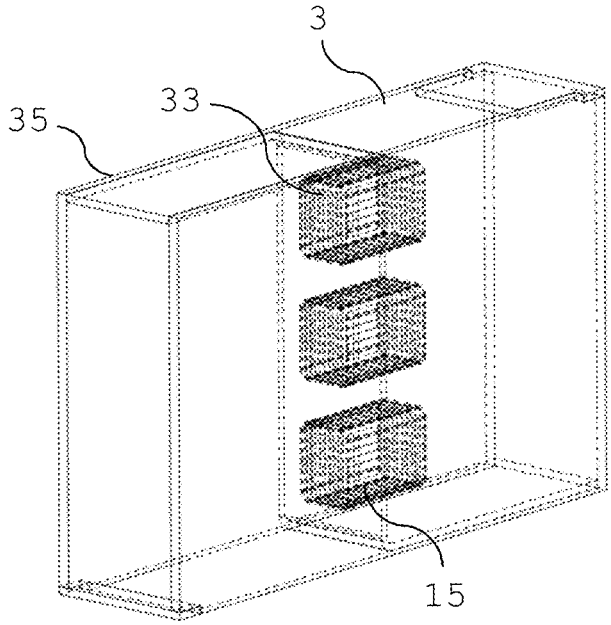
Figure 9:
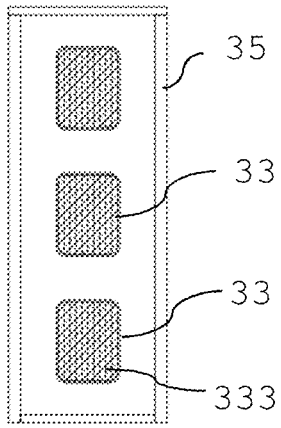
Figure 10:
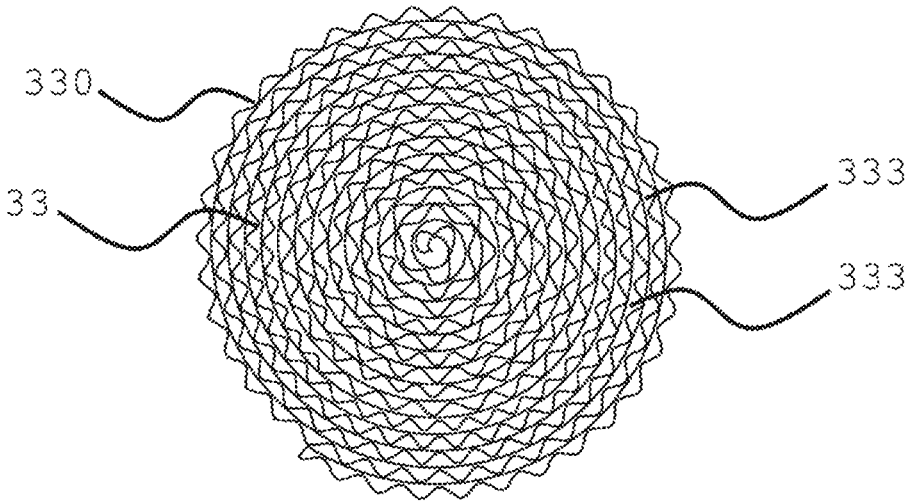
Figure 11:
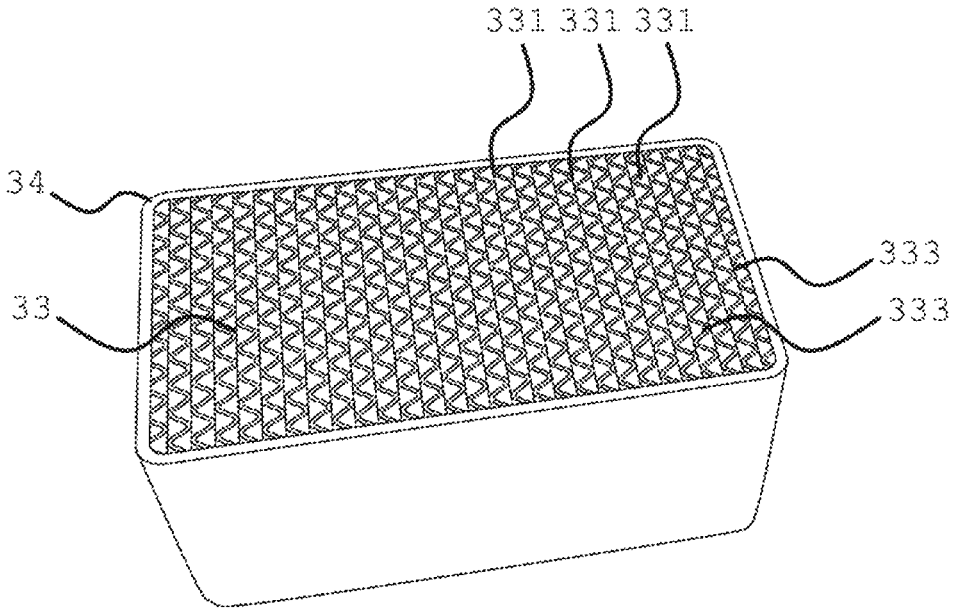
Figure 12:
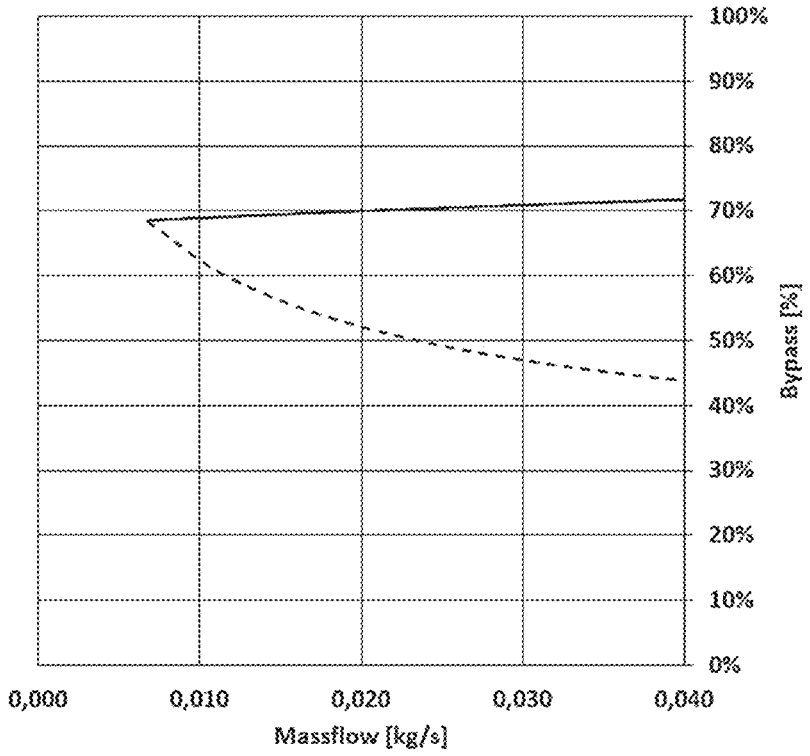

FIG. 5 schematically shows a bypass unit;

FIG. 6,7 are a perspective side view and a front view onto bypass conduits in a bypass unit;

FIGS. 8,9 show a perspective side view and a front view onto another embodiment of bypass conduits in a bypass unit;

FIG. 10 shows a bypass core;

FIG. 11 shows another embodiment of a bypass core;

FIG. 12 is a graph showing a difference between a state-of the art bypass (dashed line) versus a bypass according to the invention (solid line).

In the drawings, the same reference signs are used for the same or similar elements.

Figure 1:
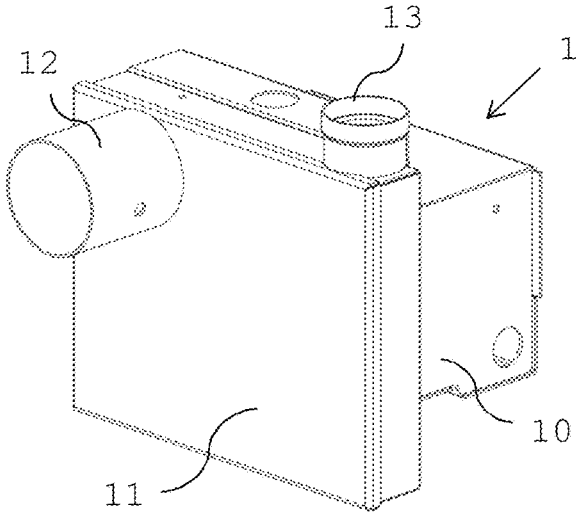
FIG. 1 shows a heat exchanger unit.
Figure 2:
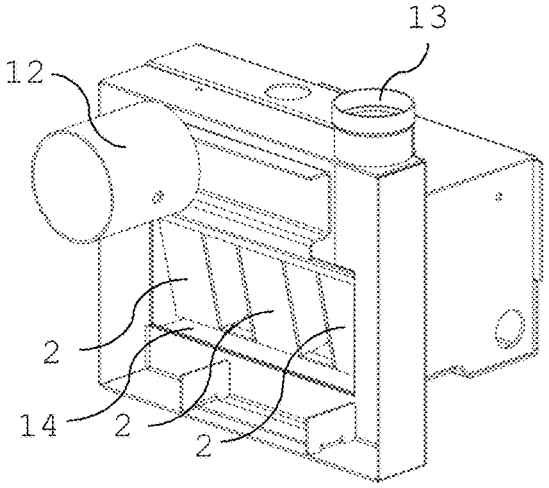
FIG. 2,3 show the heat exchanger unit in partially disassembled views.

FIG. 1 and FIG. 2 show a heat exchanger unit 1 in a main housing 10. The heat exchanger unit comprises an inlet 12 for hot fluid, for example, exhaust gas of a combustion engine, to enter the heat exchanger unit. It also comprises an outlet 13 for fluid, for example cooled and hot gas, treated in the heat exchanger unit 1. Through the outlet 13, outlet fluid may leave the heat exchanger unit 1, for example to be led into another device, for example a fuel cell.

In FIG. 2 the front wall 11 of the main housing 10 is removed. It allows view onto three parallel arranged heat exchanger cores 2, for example heat exchanger stacks, and a downstream arranged mixing chamber 14. In the mixing chamber 14, the fluid flow having passed the three heat exchanger cores 2 and the fluid flow having bypassed the three heat exchanger cores 2 in bypass conduits is mixed before the so mixed fluid flow leaves the heat exchanger unit 1 via outlet 13.

Figure 3:
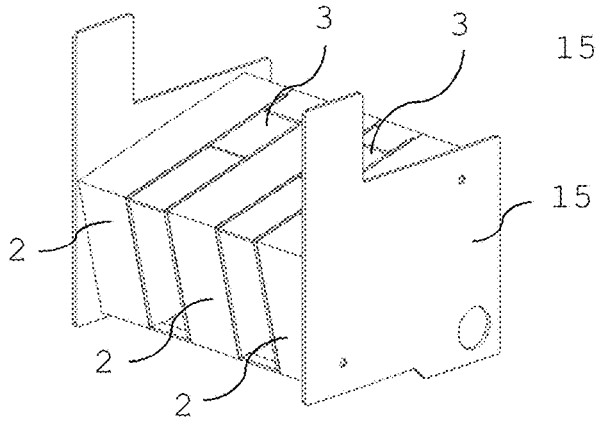

In FIG. 3, some further elements of the main housing 10 have been removed, allowing view onto two side walls 15 of the housing 10 and the three heat exchanger cores 2 arranged in between the side walls 15. Two bypass conduits 3 are arranged in between the heat exchanger cores 2.

A part of the fluid flow, a first fluid flow, from a total inlet fluid flow entering the heat exchanger unit 1 via inlet 12, is made to pass any one of the three heat exchanger cores 2. By this, heat may be transferred from a hot gas to a cool fluid to be heated up. Another part of the fluid flow entering the heat exchanger unit 1 is made to bypass the heat exchanger cores 2. This second fluid flow is led through the bypass conduits 3 in between the heat exchanger cores 2.

As may be seen in the drawing of FIG. 3, as well as in FIG. 4 and FIG. 5, the bypass conduits 3 are mainly open spaces extending over the height of the heat exchanger cores 2 before and after passing through an array 30 of bypass conduits comprising a bypass core 33 having a plurality of channels as will be described further below. The bypass fluid flow is made to pass through the bypass cores 33.

The array 30 of bypass conduits 3 are fixedly mounted in a bypass housing 35. The bypass housing 35 may be pre-manufactured and mounted in the heat exchanger unit 1 in between the heat exchanger cores. By this, bypass units 1 may be adapted to a specific use and to specific heat exchanger conditions. Construction of a heat exchanger unit 1 suitable to different applications or operation condition may thus be realized. Also modification of an existing heat exchanger unit to different operation conditions may thus be realized, for example by exchanging such bypass units.

Figure 4:
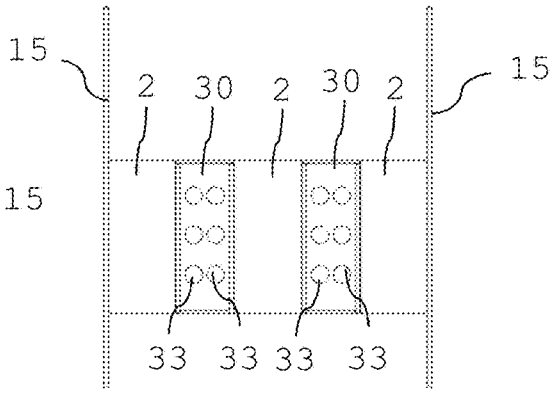
FIG. 4 is a front view onto the heat exchanger unit of FIGS. 1 to 3.

In the examples of FIG. 4 and FIG. 5, the array 30 of bypass conduits 3 comprises six circular tubes arranged in three horizontal rows of two bypass conduits each. The rows of bypass conduits of the array 30 are regularly arranged over the height of the heat exchanger stacks 2.

Figure 7:
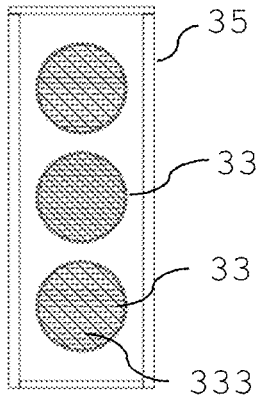

In the perspective view and the front view of FIG. 6 and FIG. 7, a bypass housing 35 comprising three bypass conduits 3 having a bypass core 33 is shown.

The three bypass cores 33 in the form of cylinders have a same size and are equidistantly arranged over the height of the heat exchanger cores 2. The longitudinal axes of the cylinders are arranged parallel to each other and along a general flow direction of the bypass fluid flow.

The bypass cores 33 comprise a plurality of channels 333 arranged longitudinally along the length of the bypass conduits. The bypass cores are embodied as cylinders formed by rolled-up corrugated sheet material. The corrugations of the sheet material, for example a sheet of corrugated stainless steel, automatically form the channels, when the sheet is rolled-up, wherein an outer winding of the sheet material touches an inner winding of the sheet material.

In the perspective view and the front view of FIG. 8 and FIG. 9, another example of a bypass housing 35 comprising three bypass conduits 3 each having a bypass core 33 is shown. The three bypass cores 33 are in the form of rectangular cuboids, have a same size and are equidistantly arranged over the height of the heat exchanger cores 2. A length of the rectangular cuboid is longer than its height and width.

The longitudinal axes of the rectangular cuboids are arranged parallel to each other and along a general flow direction of the bypass fluid flow.

The bypass cores 33 comprise a plurality of channels 333 arranged longitudinally along the length of the bypass conduits. The bypass cores 33 are formed by a plurality of corrugated plates, for example corrugated stainless steel plates. The plates may be welded to each other to prevent a displacement of the plates. The corrugations of neighbouring plates may be tilted against each other in order to prevent that neighbouring plates completely intertwine. By this, the plurality of channels extends into the longitudinal direction of the bypass cores 33, but deviate by a few degrees from being exactly parallel to a general flow direction in the bypass conduit 2.

The number of corrugates plates in a rectangular bypass core are preferably between 30 and 50 corrugates plates.

FIG. 10 shows a bypass core 33 in the form of a cylinder made by a densely rolled-up sheet of corrugated steel material. As may be seen in the figure, longitudinal channels 333 are formed by the corrugations between the individual windings of the roll.

In FIG. 11, a bypass core 33 in the form of a rectangular cuboid is shown. The bypass core 33 comprises a core housing 34. A plurality of parallel arranged plates 331 made of corrugated steel, preferably stainless steel, is arranged in the core housing 34. Channels 333 are f formed by the corrugations of and in between the plates 331. The plates are preferably welded to each other and may also be welded to the core housing 34. The core housing 34 may also be made of steel and is preferably welded to the bypass housing 35 in a fluid-tight manner. In the embodiment as depicted in FIG. 11, a fluid flow would pass from the top of the bypass core 33, through the channels 333 in the plates 331 and out at the bottom of the bypass core 33.

In FIG. 12, bypass flow rates of a state-of the art bypass (dashed line) and bypass flow rates in a heat exchanger unit according to the invention (solid line) are shown.

For the measurements of FIG. 12, a bypass core was constructed with 200 channels per square inch.

It may be seen that both bypass solutions have a same percentage of about 68 percent of the flow that bypasses the heat exchanger at a flow rate of 0.008 kg/s.

However, at larger flows, only about 43 percent of the flow bypasses the heat exchanger at a flow rate of 0.040 kg/s for the state-of-the-art solution.

According to the invention, still 72 percent of the flow bypasses the heat exchanger also at a higher flow rate of 0.040 kg/s. The flow rate through the bypass according to the invention varies thus by only about 4 percent over the shown massflow range between 0.008 kg/s and 0.04 kg/s.

Examples of heat exchanger unit characteristics are:

- A bypass core having a size of 40 mm×100 mm×100 mm (width×length×height) comprises 300 channels
- A rectangular bypass core comprising 30 to 50 plates arranged in parallel
- In a fluid flow range between 0.01 kg/s and 0.04 kg/s a bypass flow is between
  - 69 percent and 72 percent with a bypass core having 200 channels;
  - 59 percent and 64 percent with a bypass core having 300 channels;
  - 52 percent and 58 percent with a bypass core having 400 channels;
  - 44 percent and 51 percent with a bypass core having 600 channels.
- A variation of pressure drop in the bypass channel is kept below 1 mbar, preferably below 0.5 mbar over the fluid flow range of 0.01 kg/s and 0.04 kg/s, in pressure drop ranges between 4 mbar and 7.2 mbar.

The invention claimed is:

1. Heat exchanger unit for an exhaust gas system, the heat exchanger unit comprising:
   - an inlet for a fluid flow to enter the heat exchanger unit;
   - an outlet for a fluid flow to exit the heat exchanger unit;
   - the heat exchanger unit comprising a heat exchanger having a heat exchanger conduit passing through the heat exchanger and at least one passive bypass conduit bypassing the heat exchanger;
   - wherein the at least one passive bypass conduit comprises a bypass core having a plurality of channels arranged longitudinally along the passive bypass conduit, and wherein the bypass core comprises between 100 channels and 800 channels.

2. Heat exchanger unit according to claim 1, wherein the plurality of channels is arranged parallel to each other in the bypass core.

3. Heat exchanger unit according to claim 2, comprising an array of passive bypass conduits, each of the passive bypass conduits of the array of passive bypass conduits comprising a bypass core having a plurality of channels.

4. Heat exchanger unit according to claim 3, wherein at least some of the passive bypass conduits are arranged along a height of the heat exchanger.

5. Heat exchanger unit according to claim 2, wherein the plurality of channels in the bypass core is formed by corrugated sheet material.

6. Heat exchanger unit according to claim 5, wherein the plurality of channels is formed by rolled-up corrugated sheet material or corrugated plates arranged next to each other.

7. Heat exchanger unit according to claim 1, wherein the bypass core comprises between 200 channels and 600 channels.

8. Heat exchanger unit according to claim 1, comprising an array of passive bypass conduits, each of the passive bypass conduits of the array of passive bypass conduits comprising a bypass core having a plurality of channels.

9. Heat exchanger unit according to claim 8, wherein at least some of the passive bypass conduits are arranged along a height of the heat exchanger.

10. Heat exchanger unit according to claim 8, wherein the array of passive bypass conduits comprises between two and 14 passive bypass conduits.

11. Heat exchanger unit according to claim 8, comprising more than one heat exchanger core and at least a passive bypass conduit arranged in between neighbouring heat exchanger cores.

12. Heat exchanger unit according to claim 8, wherein the array of passive bypass conduits comprises between three and ten passive bypass conduits.

13. Heat exchanger unit according to claim 8, wherein the array of passive bypass conduits comprises three, four, or six passive bypass conduits.

14. Heat exchanger unit according to claim 8, comprising two, three, or four heat exchanger cores and at least a passive bypass conduit arranged in between neighbouring heat exchanger cores.

15. Heat exchanger unit according to claim 1, wherein the plurality of channels in the bypass core is formed by corrugated sheet material.

16. Heat exchanger unit according to claim 15, wherein the plurality of channels is formed by rolled-up corrugated sheet material or corrugated plates arranged next to each other.

17. Heat exchanger unit according to claim 1, wherein the bypass core comprises or is made of steel.

18. Heat exchanger unit according to claim 1, wherein the bypass core comprises a housing having a circular or rectangular cross-section.

19. Heat exchanger unit according to claim 1, comprising more than one heat exchanger core and at least a passive bypass conduit arranged in between neighbouring heat exchanger cores.

20. Heat exchanger unit according to claim 1, wherein the bypass core comprises between 250 and 450 channels.

21. Heat exchanger unit according to claim 1, wherein the bypass core comprises or is made of stainless steel.

22. Heat exchanger unit according to claim 1, comprising two, three, or four heat exchanger cores and at least a passive bypass conduit arranged in between neighbouring heat exchanger cores.

* * * * *